US006877417B2

(12) United States Patent
Shimada

(10) Patent No.: US 6,877,417 B2
(45) Date of Patent: Apr. 12, 2005

(54) FLUID PRESSURE CIRCUIT

(75) Inventor: Yoshiyuki Shimada, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 37 days.

(21) Appl. No.: 10/344,090

(22) PCT Filed: Feb. 12, 2002

(86) PCT No.: PCT/JP02/01136

§ 371 (c)(1),
(2), (4) Date: Feb. 7, 2003

(87) PCT Pub. No.: WO02/086331

PCT Pub. Date: Oct. 31, 2002

(65) Prior Publication Data

US 2003/0150210 A1 Aug. 14, 2003

(30) Foreign Application Priority Data

Apr. 17, 2001 (JP) ..... 2001-118421

(51) Int. Cl.[7] ..... F15B 11/024
(52) U.S. Cl. ..... 91/433; 91/437
(58) Field of Search ..... 91/16, 18, 433, 91/436, 437; 60/468

(56) References Cited

U.S. PATENT DOCUMENTS 5,415,076 A * 5/1995 Krone et al. ..... 91/436

FOREIGN PATENT DOCUMENTS

| | | |
|---|---|---|
| JP | 45-36432 | 11/1970 |
| JP | 55-49116 | 3/1980 |
| JP | 2-54902 | 4/1990 |
| JP | 09-132927 | 5/1997 |

* cited by examiner

*Primary Examiner*—F. Daniel Lopez
(74) *Attorney, Agent, or Firm*—Darby & Darby

(57) ABSTRACT

To perform boom-down operation by operating a boom cylinder (6) by an external load (W) while simultaneously operating an arm cylinder (26) or a bucket cylinder (27) in the state the bucket is off the ground, a first boom directional control valve (2) and a regeneration boom valve (13) are controlled to the neutral position and the open position respectively so that the hydraulic oil is regenerated from a line (9) located at the oil-returning side of the boom cylinder (6) through the regeneration boom valve (13) to a line (5) located at the oil-feeding side. Therefore, the volume of the hydraulic oil that can be supplied from the pressurized oil source (4) to the arm cylinder (26) or the bucket cylinder (27) via the second arm directional control valve (24) or the bucket directional control valve (25) is increased by the amount equivalent to the amount of the oil that is not supplied from the pressurized oil source (4) to the boom cylinder (6). As the circuit according to the invention enables the arm cylinder (26) or the bucket cylinder (27) to work faster, it increases the operating efficiency of the hydraulic excavator when its hydraulic actuators are operated simultaneously.

8 Claims, 4 Drawing Sheets

FLUID PRESSURE CIRCUIT

This is a U.S. national phase application under 35 U.S.C. §371 of International Patent Application No. PCT/JP02/01136, filed Feb. 12, 2002, and claims the benefit of Japanese Patent Application No. 2001-118421, filed Apr. 17, 2001. The International Application was published in Japanese on Oct. 31, 2002 as WO 02/086331 A1 under PCT Article 21 (2).

TECHNICAL FIELD

The present invention relates to a hydraulic circuit having a regeneration valve.

BACKGROUND OF THE INVENTION

An oil hydraulic circuit that includes a regeneration boom circuit is shown in FIG. 5 as an example. Such a circuit is typically used as a boom-down circuit in a hydraulic excavator.

Referring to FIG. 5, when a lever of an electric joystick 1 for performing boom-down operation is operated, signals from the electric joystick 1 are input through a controller 3 into a solenoid 2*a* of a first boom directional control valve 2, which is of a solenoid-operated 3-position, 6-port type. As a result, the first boom directional control valve 2 shifts upward so that hydraulic oil fed from a pressurized oil source 4 flows through a line 5 into the rod-side 7 of a boom cylinder 6. The hydraulic oil in the head-side 8 of the boom cylinder 6 flows through lines 9, 10 into a tank line 11 to cause a rod 12 to contract.

When signals from the electric joystick 1 are input through the controller 3 into a solenoid 14 of a regeneration boom valve 13 simultaneously with the input of signals into the solenoid 2*a* of the first boom directional control valve 2, the regeneration boom valve 13 shifts upward. As a result of the shifting of the regeneration boom valve 13, during the period when the pressure in the rod-side 7 is lower than the pressure in the head-side 8, a part of the return oil from the head-side 8 passes through a passage 15 and a check valve 16, which is provided in the regeneration boom valve 13, and joins the hydraulic oil fed from the pressurized oil source 4. The combined hydraulic oil flows through the line 5 into the rod-side 7. Therefore, compared with oil hydraulic circuits that are not provided with such a regenerating circuit, a greater amount of oil is fed into the rod-side 7, enabling the boom to be lowered at a higher speed.

At that time, a considerable amount of oil, i.e. the regenerated oil that is not required to be fed into the rod-side 7, is returned through a return-oil control orifice 17 of the first boom directional control valve 2 to the tank line 11, because the cross-sectional area of the single-rod type boom cylinder 6 is greater at its head-side 8 than at its rod-side 7 by the cross-sectional area of the rod 12.

Operating an electric joystick 18, which is provided to perform boom-up operation, causes signals to be input through the controller 3 into the solenoid 2*b* of the first boom directional control valve 2 in the same manner as the boom-down operation described above. As the first boom directional control valve 2 shifts downward, the hydraulic oil fed from the pressurized oil source 4 flows through a line 9 into the head-side 8, and the hydraulic oil in the rod-side flows through the line 5 and the line 10 into the tank line 11, causing the rod 12 to extend.

At the same time, signals from the electric joystick 18 are input into a solenoid 19*a* of a second boom directional control valve 19 in the same manner as described above, so that the second boom directional control valve 19, which is of a solenoid-operated 2-position, 4-port type, shifts downward. As a result, hydraulic oil from a pressurized oil source 20 passes through a line 21 and a line 22 so as to join the hydraulic oil in the line 9 and flow into the head-side 8.

Numeral 23 denotes a directional control valve which is dedicated for another hydraulic actuator and connected in series or parallel with the second boom directional control valve 19. This directional control valve 23 may be a first arm directional control valve of a solenoid-operated 3-position, 6-port type and shares the hydraulic oil from the pressurized oil source 20 with the second boom directional control valve 19 when the arm is operated simultaneously with boom-up operation.

Numerals 24 and 25 denote directional control valves which are connected in parallel (connection in series is also possible) with the first boom directional control valve 2 and dedicated for other hydraulic actuators than the boom. These directional control valves may be of a solenoid-operated 3-position, 6-port type. In the case of the present example, they are a second arm directional control valve 24 and a bucket directional control valve 25 and share the hydraulic oil from the pressurized oil source 4 when their respective actuators are operated simultaneously with boom-up operation or boom-down operation.

The first arm directional control valve 23 and the second arm directional control valve 24 are adapted to shift their respective positions as a result of operating an arm-operating electric joystick (not shown) so that, in the same manner as the operation for raising the boom, the hydraulic oil from the directional control valves 23, 24 are joined and fed into an arm cylinder 26, while return oil flows to a tank. Thus, the rod of the arm cylinder 26 is contracted or extended.

The bucket directional control valve 25, too, is adapted to function in the same manner as above so as to cause a bucket cylinder 27 to contract or extend as a result of operating an electric joystick (not shown) for operating the bucket.

An oil hydraulic circuit having a configuration described above presents the following problem:

(1) when lowering the boom by the boom cylinder 6 while simultaneously operating another hydraulic actuator, such as a bucket, in the state that the bucket is off the ground, the oil fed from the pressurized oil source 4 is divided and distributed to the boom cylinder 6 and the bucket cylinder 27, causing such problems as a slower action of the bucket and reduced operation efficiency in comparison with operating the bucket alone;

(2) although a sufficient amount of regenerated oil can be fed to the rod-side 7 from the head-side 8 when the bucket is off the ground, the configuration described above, which calls for additionally feeding oil from the pressurized oil source 4, requires a considerable amount of excess oil to be returned to the tank line 11, resulting in wasted energy caused by unnecessary supply of fluid from a pump of the pressurized oil source 4;

(3) considerable skill is required to perform triple combined operation, which calls for simultaneously performing boom-up, arm-drawing, and bucket-opening and may be typically performed in a quarry to rake in gravel or debris; and (4) when performing so-called slope tamping, i.e. hardening the ground by tamping it with the bottom of a bucket by lowering the boom, by repeatedly raising and lowering the boom, considerable skill is required to perform satisfactory slope tamping continuously, because failing to raise the boom at the precise moment that the bottom of the bucket touches the ground may result in various problems, such as tamping the ground too hard or causing the vehicle body to rise due to the reaction force resulting from the boom-down operation.

In order to solve the above problem, an object of the present invention is to prevent a decrease in efficiency of performance of a work machine, eliminate energy waste, and also facilitate operation that would otherwise require considerable experience or, skill.

DISCLOSURE OF THE INVENTION

A hydraulic circuit according to the invention includes one directional control valve adapted to receive hydraulic fluid from a pressurized fluid source and control the direction of the flow of the hydraulic fluid by shifting the position of said one directional control valve; one hydraulic actuator adapted to be operated by an external load or hydraulic fluid, of which the direction of the flow is controlled by the said directional control valve; a regeneration valve for opening or closing off a passage that connects the fluid-returning side and the fluid-feeding side of the aforementioned hydraulic actuator operated by an external load; a pressure detector for detecting load pressure applied to the aforementioned hydraulic actuator; at least one other directional control valve adapted to receive hydraulic fluid from the pressurized fluid source and control the direction of the flow of the hydraulic fluid by shifting the position of said other directional control valve(s); at least one other hydraulic actuator adapted to be operated by hydraulic fluid, of which the direction of the flow is controlled by the said other directional control valve; and a controller that is adapted to, upon detecting the load pressure to said one hydraulic actuator to be low by means of said pressure detector, shift said one directional control valve to the neutral position, thereby interrupting the flow of the hydraulic fluid to said one hydraulic actuator, and simultaneously control the regeneration valve to be open. When operating said one hydraulic actuator by an external load during simultaneous operation of the two hydraulic actuators, the circuit described above enables the hydraulic fluid to be regenerated from the fluid-returning side of the hydraulic actuator through the regeneration valve to the fluid-feeding side of said one hydraulic actuator by controlling said one directional control valve to the neutral position and the regeneration valve to remain open. Therefore, the hydraulic fluid that can be supplied from the pressurized fluid source to said other hydraulic actuator via said other directional control valve is increased by the amount equivalent to the amount of the hydraulic fluid that is not supplied from the pressurized fluid source to said one hydraulic actuator. As a result, said other hydraulic actuator can work faster in comparison with conventional circuits. The circuit according to the invention thus increases the operating efficiency of the hydraulic excavator when its hydraulic actuators are operated simultaneously.

According to another feature of the invention, when being at the neutral position, said one directional control valve is capable of discharging into the tank the hydraulic fluid that has been fed from the pressurized fluid source. In cases where said one hydraulic actuator can be actuated by opening the regeneration valve even if said one directional control valve is at the neutral position, the hydraulic fluid fed from the pressurized fluid source to said one directional control valve is discharged to the tank through said one directional control valve, which is at the neutral position. Therefore, the invention is effective in preventing energy loss that would otherwise occur as a result of unnecessary supply of the hydraulic fluid from the pressurized fluid source to said one hydraulic actuator.

According to yet another feature of the invention, the hydraulic circuit includes yet another directional control valve, which is adapted to receive hydraulic fluid from a pressurized fluid source other than the one mentioned above and shift the position of said yet another directional control valve so that, by shifting to one position, said yet another directional control valve permits the hydraulic fluid fed from the other pressurized fluid source and the hydraulic fluid returned from said one hydraulic actuator to be discharged into the tank and that, by shifting to another position, said yet another directional control valve supplies said one hydraulic actuator with the hydraulic fluid fed from the other pressurized fluid source. By shifting to one position, said yet another directional control valve permits the hydraulic fluid fed from the other pressurized fluid source to be discharged into the tank and also permits the excess hydraulic fluid delivered from said one hydraulic actuator to be discharged into the tank. Therefore, the energy loss can be reduced. Furthermore, by shifting to the other position, said yet another directional control valve permits the flow of hydraulic fluid supplied from the other pressurized fluid source to join the flow of the hydraulic fluid supplied from said one directional control valve to said one hydraulic actuator, thereby increasing the working speed of said one hydraulic actuator.

According to yet another feature of the invention, the hydraulic circuit includes a check valve and a switch adapted to transmit an outside signal to the check valve, wherein the check valve functions with the direction in which the hydraulic fluid discharged from said one hydraulic actuator when said one hydraulic actuator is operated by an external load flows back through the regeneration valve to said one hydraulic actuator being regarded as the normal direction, and the check valve is also adapted to permit, when receiving an appropriate outside signal, the hydraulic fluid to flow in the reverse direction. With the configuration as above, the check valve normally prevents the reverse flow of the hydraulic fluid and secures only the flow of the regenerated hydraulic fluid discharged from said one hydraulic actuator, which is operated by an external load. When an outside signal is transmitted from the switch to the check valve, the checking function of the check valve to prevent the reverse flow is stopped. Therefore, the circuit having this feature has an ability to permit an external force to move said one hydraulic actuator through operation of the switch.

According to yet another feature of the invention, the hydraulic circuit includes a makeup check valve that is capable of feeding hydraulic fluid from the tank to a portion located downstream from the regeneration valve in the flow of regenerated fluid so as to make up deficiency of hydraulic fluid in that portion. Therefore, should the flow rate of the regenerated fluid become insufficient, the hydraulic fluid that would be sufficient to make up for the shortage can be introduced from the tank through the makeup check valve and supplied to said one hydraulic actuator.

According to yet another feature of the invention, said one hydraulic actuator is a boom cylinder for raising or lowering the boom of a front attachment of a hydraulic excavator, and said other hydraulic actuator is a hydraulic actuator or hydraulic actuators other than the boom cylinder of the hydraulic excavator. When lowering the boom by the boom cylinder while simultaneously operating said other hydraulic actuator in the state that the front attachment of the hydraulic excavator is off the ground, there is no need of feeding the hydraulic fluid from the pressurized fluid source to the boom cylinder, and all the hydraulic fluid can be supplied to the other hydraulic actuator. Therefore, the circuit having this feature enables the other hydraulic actuator to move faster in comparison with conventional circuits and consequently offers an increased operation efficiency when operating these actuators simultaneously.

According to yet another feature of the invention, said one hydraulic actuator is a boom cylinder for raising or lowering the boom of a front attachment of a hydraulic excavator; a plurality of hydraulic actuators comprise said other hydraulic actuator, said plurality of hydraulic actuators including at least an arm cylinder for swinging the arm, which is supported at the end of the boom by means of a shaft, and a bucket cylinder for swinging the bucket, which is supported at the end of the arm by means of a shaft; and at least said one directional control valve has a return-oil control orifice adapted to reduce the return oil discharged from the head-side of the boom cylinder into the tank when said one directional control valve is at the boom-down position. When raking in gravel or debris with the bottom of the bucket of a hydraulic excavator in contact with the ground, a conventional circuit requires the operator of the excavator to perform triple combined operation which calls for simultaneously performing boom-up, arm-drawing and bucket-opening. According to the present invention, however, the boom cylinder can extend or contract at will in the axial direction in response to an external force, provided that the regeneration valve is open and that the switch is on. Therefore, gravel or debris can be easily raked in by merely drawing the arm and opening the bucket while pushing the front attachment downward by maintaining said one directional control valve in the boom-down mode. Furthermore, in the course of slope tamping, which calls for hardening the ground by tamping it with the bottom of the bucket by lowering the boom, when the pressure of the hydraulic fluid to the rod-side of the boom cylinder tends to increase with the bucket coming into contact with the ground, the pressure is released to the tank via the check valve when the switch is on, the regeneration valve in the open state, and the return-oil control orifice of said one directional control valve. Therefore, as an impact of the bucket with the ground will not produce a boom-down force that is great enough to raise the vehicle, continuous slope tamping can easily be performed.

According to yet another feature of the invention, the controller has a function to control the circuit so that when pressure at the rod-side of the boom cylinder is greater than a given standard pressure, an outside signal for releasing the check valve from checking the reverse flow is prevented from being input from the switch to the check valve even if the switch is turned on. Without this function of the controller, should an outside signal be input from the switch into the check valve by turning on the switch in the state where there is high pressure at the rod-side, in other words in the state where the bucket is in contact with the ground with the vehicle body in the raised state as a result of boom-down operation by the boom cylinder, the checking function of the check valve is stopped. Therefore, should the operator unintentionally perform boom-down operation, in other words unintentionally try to further raise the vehicle body, the regeneration valve immediately shifts to the open state so that the hydraulic fluid at the rod-side flows through the check valve and the regeneration valve to the head-side, thereby causing the boom cylinder to extend to extend, resulting in boom-up action and, consequently, causing the vehicle body to fall to the ground. However, the function of the controller to control the check valve as described above is capable of preventing such an accidental falling of the vehicle body.

PREFERRED EMBODIMENT OF THE INVENTION

Figure 1:
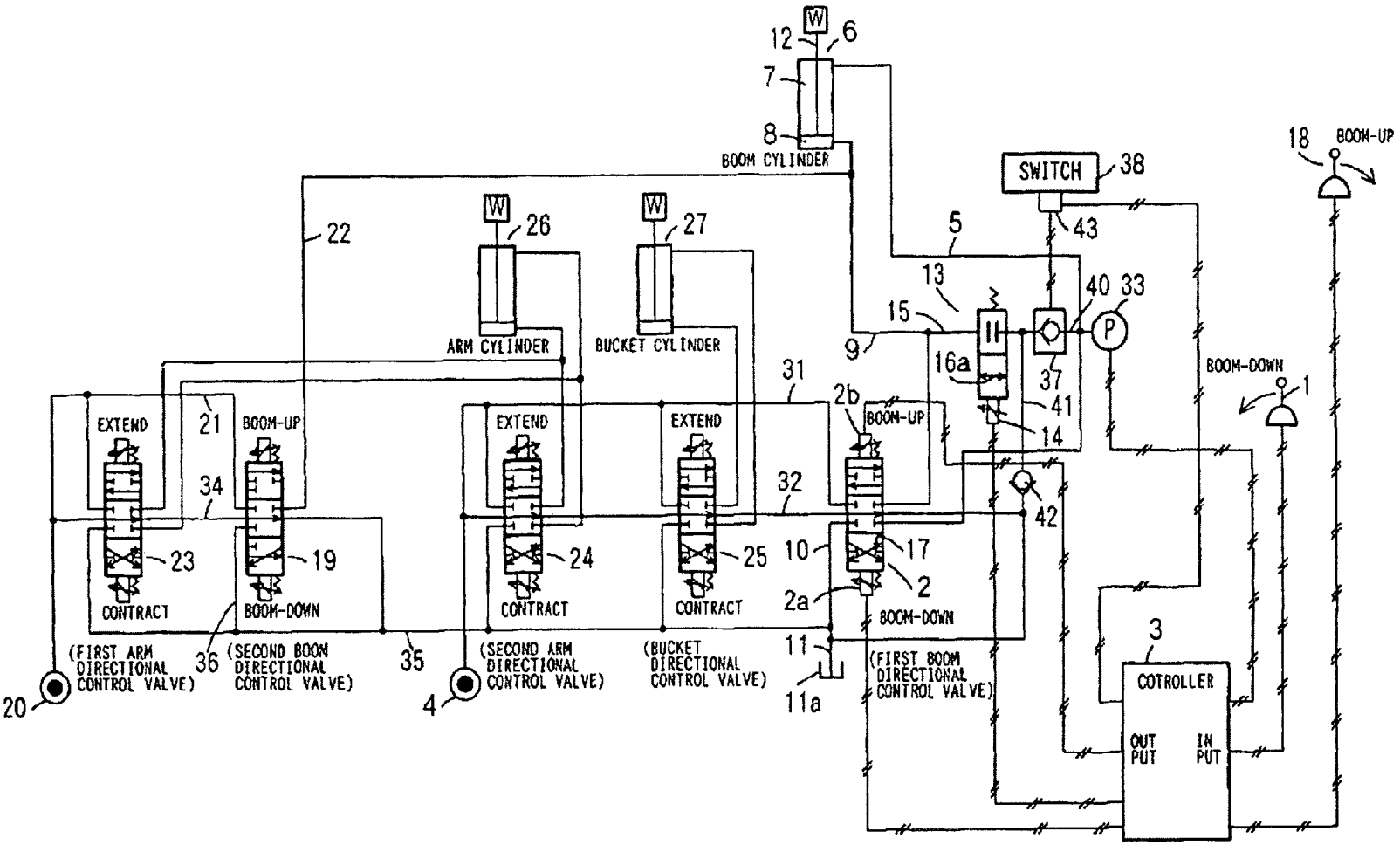
FIG. 1 is a circuit diagram of a hydraulic circuit according to an embodiment of the present invention.
Figure 2:
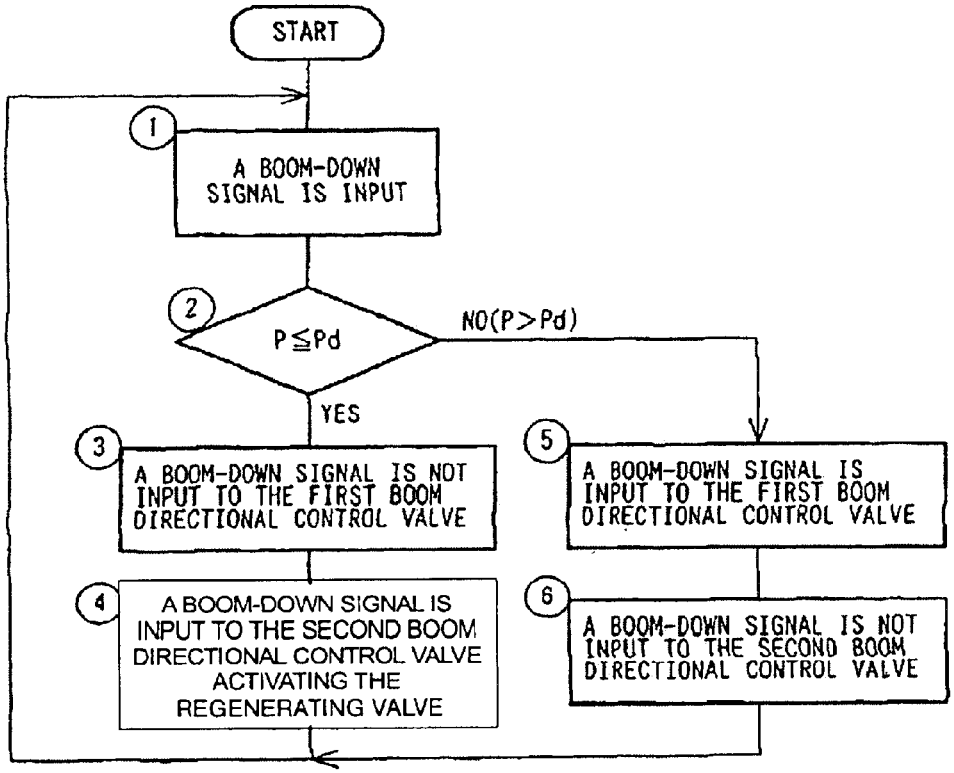
FIG. 2 is a flow chart to explain the process of controlling directional control valves through a controller provided in the said hydraulic circuit.
Figure 3:
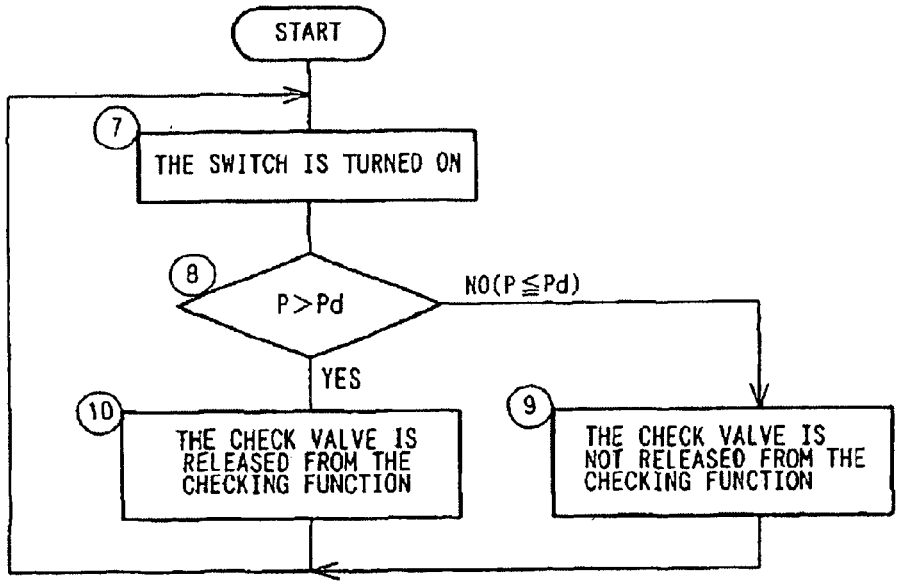
FIG. 3 is a flow chart to explain the process of controlling a check valve through the controller of the said hydraulic circuit.
Figure 4:
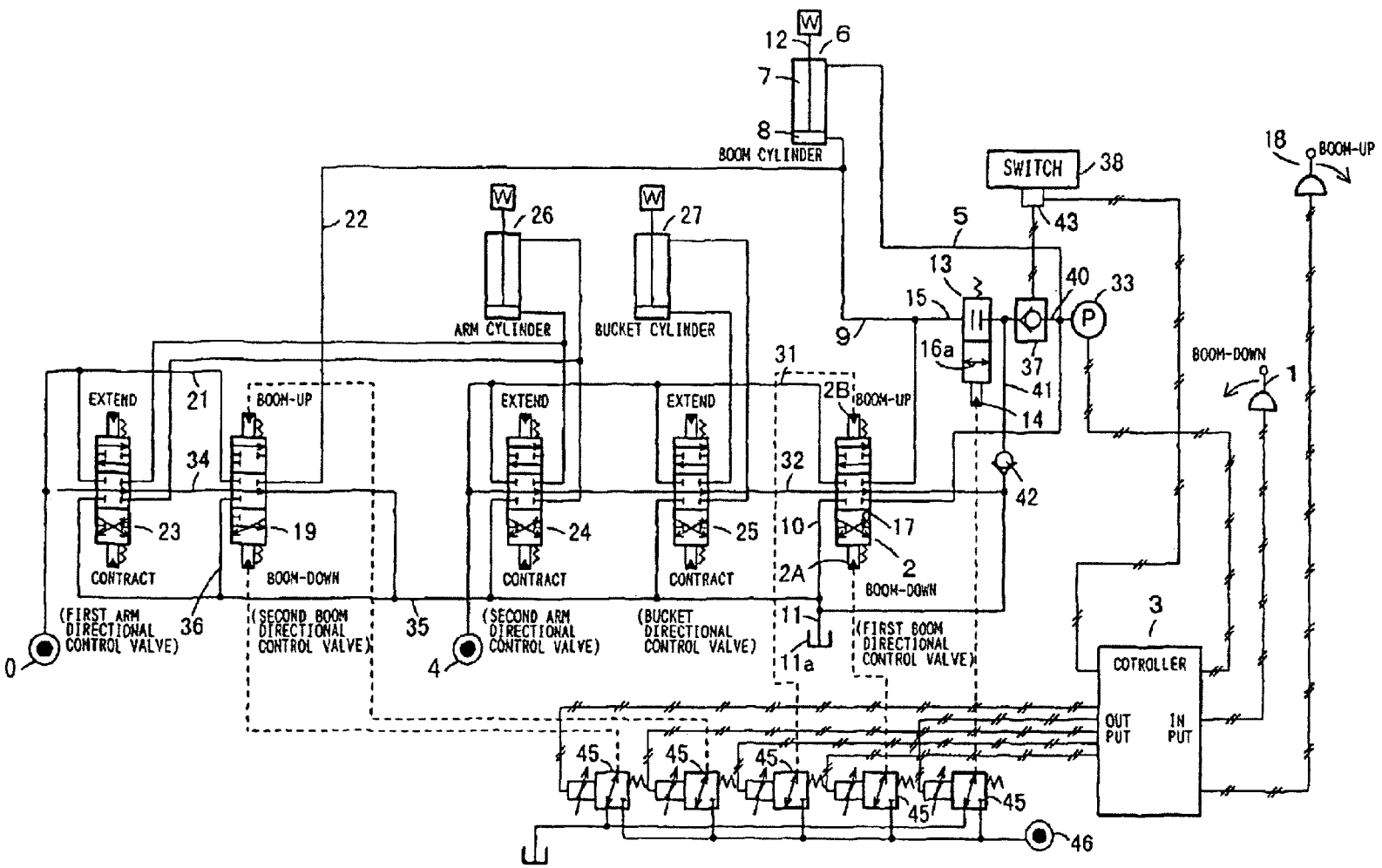
FIG. 4 is a circuit diagram of a hydraulic circuit according to another embodiment of the present invention.
Figure 5:
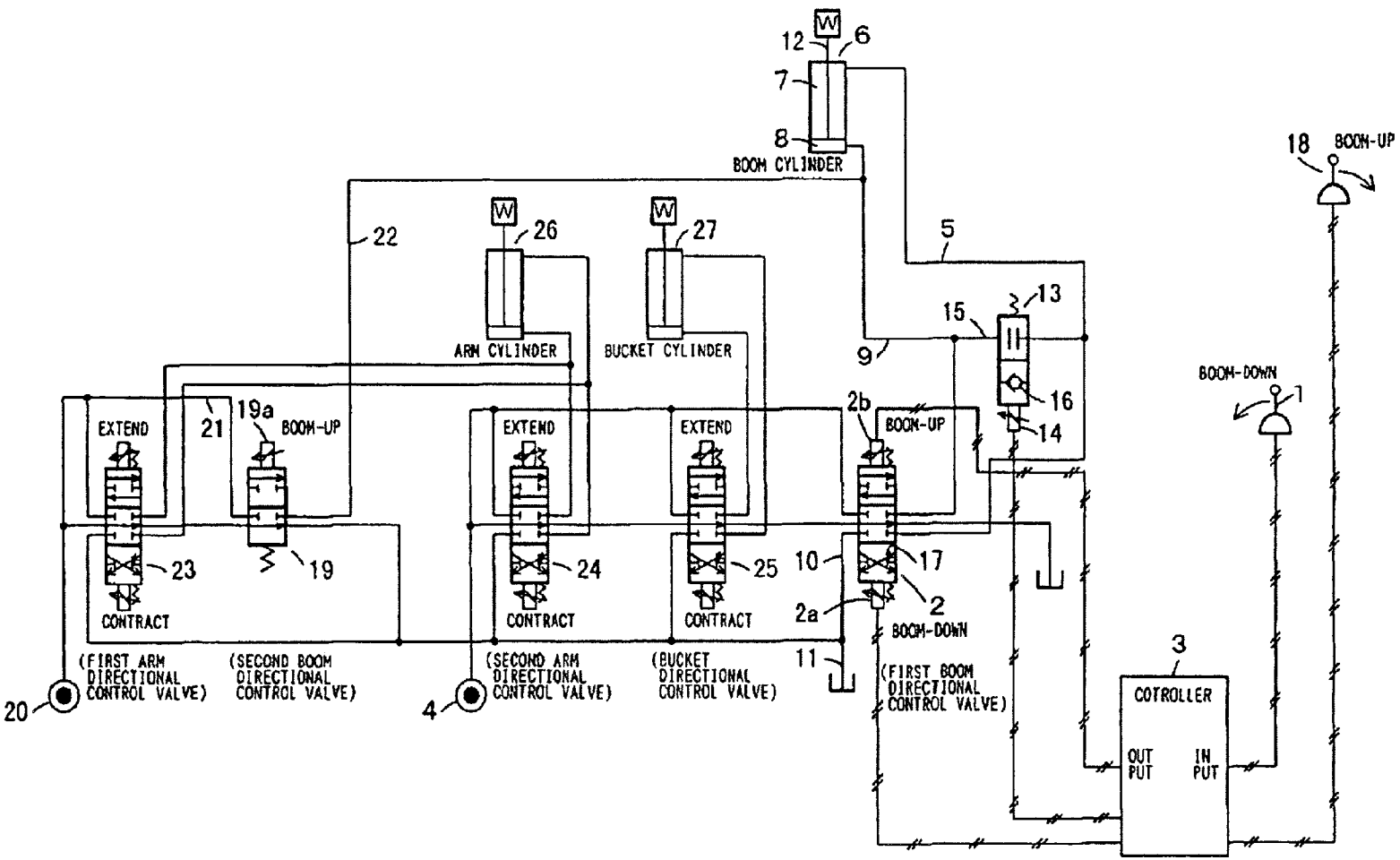
FIG. 5 (Prior Art)
FIG. 5 is a circuit diagram of a conventional oil hydraulic circuit.

Next, the present invention is explained in detail, referring to an embodiment thereof shown in FIGS. 1 through 3 and another embodiment thereof shown in FIG. 4. In the explanation hereunder, the elements similar to those of the example of a conventional circuit shown in FIG. 5 are identified with the same reference numerals.

FIG. 1 shows an example of an oil hydraulic circuit as a hydraulic circuit that includes a boom-down regeneration circuit. In the oil hydraulic circuit, a directional control valve, i.e. a first boom directional control valve 2, is connected via a line 31 and a center by-pass line 32 to a pressurized oil source 4, which serves as a pressurized fluid source. The line 31 and the center by-pass line 32 function to feed hydraulic oil (or simply referred to as 'oil') as hydraulic fluid.

The first boom directional control valve 2 is a control valve adapted to receive hydraulic oil fed from the pressurized oil source 4 and control the direction of the flow of the hydraulic oil by changing the position of its spool according to electric signals fed to its solenoids 2*a*, 2*b*. With the direction of its flow thus controlled by the first boom directional control valve 2, the hydraulic oil contracts or extends a boom cylinder 6 which serves as a hydraulic actuator.

The first boom directional control valve 2 is provided therein with a return-oil control orifice 17 adapted to reduce the volume of the return oil discharged from the head-side 8 of the boom cylinder 6 through the tank line 11 into the tank 11*a* when the first boom directional control valve 2 is at the boom-down position.

The boom cylinder 6 is a hydraulic actuator for raising or lowering a boom of a front attachment mounted on a revolving superstructure, which is rotatably mounted on the lower structure of a hydraulic excavator.

A second boom directional control valve 24 and a bucket directional control valve 25, too, are connected to the pressurized oil source 4. The second boom directional control valve 24 is another directional control valve that is adapted to shift its position upon receipt of hydraulic oil from the pressurized oil source 4 so as to control the direction of the flow of the hydraulic oil. Other hydraulic actuators, i.e. an arm cylinder 26 and a bucket cylinder 27, which are adapted to be operated by the hydraulic oil of which the directions of the flows are respectively controlled by the second boom directional control valve 24 and the bucket directional control valve 25 are connected to these directional control valves 24, 25. In addition to the boom cylinder 6, the arm cylinder 26 and the bucket cylinder 27 constitute the hydraulic actuators of the hydraulic excavator.

The arm cylinder 26 is a hydraulic actuator for swinging the arm, which is supported at the end of the boom of the hydraulic excavator by means of a shaft. The bucket cylinder 27 is a hydraulic actuator for swinging the bucket, which is supported at the end of the arm by means of a shaft.

There may be occasions where the dead weight of a front attachment of the hydraulic excavator is applied to the boom cylinder 6 as an external load W. A regeneration boom valve 13 is disposed in a passage 15 that connects a line 9 and a line 5. The line 9 is located at the oil-returning side of the boom cylinder 6, which will be contracted by an external load W. The line 5 is located at the oil-feeding side of the boom cylinder 6. The regeneration boom valve 13 is adapted to function as a regeneration valve for opening or closing off the passage 15.

The line 5 at the oil-feeding side includes a pressure detector 33 for detecting load pressure at the rod-side the rod-side of the boom cylinder 6. The pressure detector 33 is connected to an input section of the controller 3.

In addition to the pressure detector 33, electric joysticks 1, 18 for operating the boom and other electric joysticks (not shown) for operating the other devices than the boom are connected to the input section of the controller 3.

In addition to a solenoid 14 of the regeneration boom valve 13, solenoids 2*a*, 2*b* of the first boom directional control valve 2 and the solenoids of the other directional control valves 19, 23, 24, 25 are connected to an output section of the controller 3.

The controller 3 has a function such that when the pressure detector 33 detects the load pressure at the rod-side 7 of the boom cylinder 6 to be low at the time that a boom-down signal is input into the controller 3, the controller 3 controls the first boom directional control valve 2 to the neutral position to close off the passage for the hydraulic oil to the actuator and simultaneously opens or keeps open the regeneration boom valve 13.

The first boom directional control valve 2 has such a circuit configuration that when the first boom directional control valve 2 is at the neutral position, the hydraulic oil fed from the pressurized oil source 4 via the center by-pass line 32 to the first boom directional control valve 2 is discharged into the tank line 11.

In addition to the pressurized oil source 4, the hydraulic circuit of the embodiment includes a pressurized oil source 20 as another pressurized fluid source, and a second boom directional control valve 19, which serves as another directional control valve, is connected to the pressurized oil source 20 via a line 21 and a center by-pass line 34, which are passages to carry the hydraulic oil.

The second boom directional control valve 19 has a circuit configuration of a 3-position, 5-port type such as follows: when the second boom directional control valve 19 is at the neutral position, the center by-pass line 34 communicates with the tank line 11 via a line 35; when the second boom directional control valve 19 shifts to one side, i.e. to the boom-down position, the hydraulic oil fed from the pressurized oil source 20 via the center by-pass line 34 is discharged into the tank line 11 via the line 35, while the hydraulic oil returned from the head-side 8 of the boom cylinder 6 via a line 22 is discharged into the tank line 11 via a line 36 and the line 35; and when the second boom directional control valve 19 shifts to the other side, i.e. to the boom-up position, the hydraulic oil fed from the pressurized oil source 20 via the line 21 is fed to the head-side 8 of the boom cylinder 6 via the line 22 so that the boom cylinder 6 can be extended quicker.

With the configuration as above, the hydraulic circuit includes a check valve 37, which is of a type to be operated by outside signals, and a switch 38 for transmitting outside signals to the check valve 37 to stop the checking function of the check valve 37. The check valve 37 is connected to the portion of the circuit to which the hydraulic oil discharged from the head-side 8 of the boom cylinder 6 into the line 9 flows out of the regeneration boom valve 13, when the boom cylinder 6 is lowered by an external load W.

The check valve 37 of an outside-signal operated type regards the direction in which the hydraulic oil that has been discharged from the head-side 8 of the boom cylinder 6 in the process of lowering the boom cylinder 6 by an external load W flows through the regeneration boom valve 13 and is regenerated to the rod-side of the boom cylinder 6 as the normal direction. The check valve 37 is also capable of permitting the hydraulic oil to flow in reverse upon receipt of an appropriate outside signal from the switch 38.

A line 41 branches off from a regenerated oil guiding line 40 that extends from the regeneration boom valve 13 to the rod-side line 5. To be more specific, the line 41 branches off from the portion of the passage that connects the regeneration boom valve 13 and the check valve 37. A makeup check valve 42 that is capable of feeding hydraulic oil from the tank line 11 to the regenerated oil guiding line 40 for replenishment of hydraulic oil is provided in the line 41.

The controller 3 has a function as a switch-signal canceling means. To be more specific, when pressure at the rod-side 7 of the boom cylinder 6 is greater than a given standard pressure Pd, the controller 3 controls its switch signal control unit 43 so that an outside signal for releasing the check valve 37 from checking the reverse flow is prevented from being input from the switch 38 to the check valve 37 even if the switch 38 is turned on.

As described above, the embodiment shown in FIG. 1 is different from the conventional art shown in FIG. 5 in that the second boom directional control valve 19 is a directional control valve of a 3-position, 5-port type. Another difference lies in the configuration of a check valve: in the place of the check valve 16, which is disposed inside the regeneration boom valve 13 in the conventional circuit shown in FIG. 5, the embodiment shown in FIG. 1 includes a two-way passage 16*a*, which is located in the regeneration boom valve 13, and a check valve 37 which is disposed downstream from the regeneration boom valve 13. The check valve 37 is adapted to be operated by outside signals so as to permit not only the normal-direction flow but also the reverse flow, in other words permit the hydraulic oil to flow from the rod-side 7 to the head-side 8, in accordance with outside signals. As a result of this configuration, when the switch 38 is turned on, an outside signal is input into the check valve 37 and causes the hydraulic oil to flow from the rod-side 7 to the head-side 8.

A pressure detector 33 is attached to the line 5 so as to detect the pressure at the rod-side 7 of the boom cylinder 6 and convey signals indicating the detected pressure to the controller 3.

The second boom directional control valve 19 has a configuration such that when an electric signal is input from the controller 3, the second boom directional control valve 19 shifts upward so that a part of the return oil fed from the head-side 8 of the boom cylinder 6 passes through the line 22, from which it flows into the tank line 11 via the second boom directional control valve 19 and the line 36, while the oil fed from the pressurized oil source 20 through the center by-pass line 34, too, flows into the tank line 11 without being interrupted.

Yet another difference of the embodiment from the conventional circuit lies in that the line 41 branches off from the regenerated oil guiding line 40 and is connected via the makeup check valve 42 to the tank line 11. Therefore, should the oil pressure become lower than the tank line pressure at a some point downstream from the regeneration boom valve 13 in the regenerated oil flow, the hydraulic oil can be supplied from the tank line 11 through the makeup check valve 42 to make up the shortfall in oil pressure at the aforementioned downstream point.

Next, the function of the embodiment shown in FIG. 1 is explained hereunder, referring to flow charts shown in FIGS. 2 and 3. Numerals enclosed with circles in the flow charts represent step numbers.

First, an explanation is given of the state that the switch 38 is off, in other words the state that no outside signal is being input into the check valve 37.

In lowering the boom when the attachment is off the ground, the boom usually descends by its own weight.

Therefore, it is sufficient to feed the absolute minimum amount of oil required to operate the boom without the shortage of oil to the rod-side 7 producing vacuum. In other words, the oil regenerated from the head-side 8 alone is sufficient. Taking into consideration the fact that there is no problem even if no oil is fed from the pressurized oil source 4 through the first boom directional control valve 2 to the boom cylinder 6, boom-down operation is performed with the first boom directional control valve 2 returning to the neutral position to interrupt the oil flow from the pressurized oil source 4 when the front attachment is off the ground.

To be more specific, when a boom-down signal is input from the electric joystick 1 to the controller 3 (Step 1), the pressure at the rod-side pressure P can be represented as P≦Pd, wherein Pd represents the standard pressure which functions as the standard for judgment ('Yes' in Step 2). This is because virtually no pressure rises in the line 5 at the rod-side of the boom cylinder 6 in the course of boom-down operation in the state where the bucket is off the ground, wherein the boom descends by its own weight. Even if a boom-down signal is input from the electric joystick 1 to the controller 3 during this period, the controller 3 does not output an electric signal that indicates boom-down operation to the first boom directional control valve 2, as the controller 3 has received the signal from the pressure detector 33 (Step 3), so that the first boom directional control valve 2 remains at the neutral position.

To summarize, when the rod-side pressure P is not greater than the standard pressure Pd (P≦Pd) in the course of lowering the boom in the state where the bucket is off the ground, the first boom directional control valve 2 is at the neutral position so as to interrupt the flow of the oil supplied from the pressurized oil source 4 to the boom cylinder 6.

At the same time, a boom-down electric signal is output from the controller 3 to the second boom directional control valve 19 (Step 4) so that the second boom directional control valve 19 shifts upward. As a result, of the return oil from the head-side 8 of the boom cylinder 6, the excess oil, i.e. the oil that is not the hydraulic oil returned to the rod-side 7 through the check valve 37, is discharged through the internal passage in the second boom directional control valve 19, the line 36, and the line 35 to the tank line 11.

During the steps described above, the oil flow from the line 21 is interrupted, while the center by-pass line 34 remains open so as to permit the oil to flow through the line 35 into the tank line 11.

When the rod-side pressure P is greater than Pd ('NO' in Step 2), and it is necessary to feed pressurized oil from the pressurized oil source 4 to the rod-side of the boom cylinder 6 (for example, when performing rolling compaction or scraping-down of a slope by lowering the boom) the controller 3 outputs a lowering signal to the solenoid 2*a* of the first boom directional control valve 2 to switch over (Step 5) so that the pressurized oil fed from the pressurized oil source 4 through the line 31 passes through the line 5 and is supplied to the rod-side 7 of the boom cylinder 6. Meanwhile, the second boom directional control valve 19 does not shift in reverse and remains closed (Step 6) so that the excess oil is discharged through the return-oil control orifice 17 of the first boom directional control valve 2 to the tank line 11 in the same manner as the conventional art described above.

As the makeup check valve 42 is provided, there is no possibility of a part of the regenerated oil undesirably flowing into the tank line 11 through the line 41. However, should there arise the possibility of a vacuum being formed in the rod-side 7 by a temporary shortage of the oil supplied from the head-side 8 through the regeneration boom valve 13 to the rod-side 7 when the rod 12 of the boom cylinder 6 contracts, the makeup check valve 42 functions to ensure the oil flows from the tank line 11 to make up for the shortage of the oil.

Next, an explanation is given of the state that the switch 38 is on, in other words the state that an outside signal has been or is being input into the check valve 37.

When the switch 38 is turned on (Step 7), the controller 3 determines whether the pressure P is greater than Pd (P>Pd) at the rod-side 7 of the boom cylinder 6 (Step 8). If the pressure P at the rod-side 7 of the boom cylinder 6 is P≦Pd ('NO' in Step 8), the controller 3 stops the checking action of the check valve 37 based on an outside signal from the switch 38 (Step 9). When the regeneration boom valve 13 shifts from the closed state to the open state by boom-down operation, the oil is permitted to freely flow back and forth between the head-side 8 and the rod-side 7 of the boom cylinder 6 so that the rod 12 of the boom cylinder 6 can extend or contract in response to an external force in the axial direction.

As a result, gravel and other debris can be easily raked in by merely drawing the arm and opening the bucket in the state that the boom-down lever is appropriately operated. Continuous slope tamping can be easily performed in this state, because the vehicle body is prevented from rising even when the bottom of the bucket touches the ground.

When the pressure P is greater than Pd (P>Pd) at the rod-side 7 of the boom cylinder 6 ('YES' in Step 8), the controller 3 interrupts outside signals from the switch 38 to the check valve 37 so as not to releasing the check valve 37 from checking action even if the switch 38 is turned on (Step 10).

This is to prevent the vehicle from falling to the ground. Should the operator turn on the switch 38 and unintentionally perform boom-down operation, in other words unintentionally try to further raise the vehicle body, when the vehicle body is already in the raised state with the bucket in contact with the ground as a result of boom-down operation by the boom cylinder 6 (P>Pd), the regeneration boom valve 13 shifts to the open state the moment the operator tries to lower the boom, and the oil in the rod-side 7 flows through the check valve 37 and the regeneration boom valve 13 to the head-side 8 if the controller does not have the function described in Step 10. When the oil flows to the head-side 8, the rod 12 of the boom cylinder 6 extends instantly, thereby raising the boom and, consequently, causing the vehicle body to fall to the ground. Because of function described in Step 10, however, the present embodiment is free from such a problem.

Next, the effects of the embodiment shown in FIG. 1 is explained.

In the explanation hereunder, (1) and (2) refer to results that can be achieved regardless of whether the switch 38 is on or off, whereas (3) and (4) refer to results that can be achieved only when the switch 38 is on.

(1) When lowering the boom by the boom cylinder 6 while simultaneously operating other hydraulic actuators, such as an arm cylinder 26 or a bucket cylinder 27, which is in the off-the-ground state, the oil from the pressurized oil source 4 is not fed to the boom cylinder 6. In other words, all the oil is supplied to the arm cylinder 26 and the bucket cylinder 27, thereby enabling the arm and the bucket to move considerably faster in comparison with conventional circuits. Therefore, an increased operation efficiency is ensured.

Although the above explanations refer to the arm cylinder 27 and bucket cylinder 27 as examples of other hydraulic actuators, a drive motor of the lower structure of a hydraulic excavator and a turntable motor for rotating the superstructure on the lower structure are also included in the examples of 'other hydraulic actuators', and connecting any one of these actuators in series or parallel with the first boom directional control valve 2 enables it to work faster and consequently increase its operation efficiency.

(2) During operation of lowering the boom alone when the bucket is in the off-the-ground state, the first boom directional control valve 2 does not shift and remains at the neutral position. As the hydraulic oil supplied from the pressurized oil source 4 flows directly through the by-pass center line 32 to the tank line 11, the pump rate suffers only a minimum energy loss. In cases where a variable delivery pump is used in the pressurized oil source 4, the energy loss is reduced even further, because, when the directional control valve is at the neutral position, a negative control mechanism of the variable delivery pump functions normally to reduce the pump rate to an absolute minimum.

Even when the second boom directional control valve 19 shifts upward by boom-down operation, the second boom directional control valve 19 does not close off the center by-pass line 34. Furthermore, as a result of this upward shifting, the second boom directional control valve 19 guides into the line 36 and then discharges into the tank line 11 the excess oil that has flowed from the head-side 8 of the boom cylinder 6 into the line 22. Therefore, the energy loss can be kept at a minimum.

(3) When performing work that requires supply of pressurized oil from the pressurized oil source 4, for example performing rolling compaction or scraping-down of a slope by lowering the boom, such work can be done in the same manner as in the case of a conventional circuit.

(4) Conventional circuits necessitate triple combined operation that calls for simultaneously operating boom-up, arm-drawing, and bucket-opening to rake in gravel or debris or other similar work with the bottom of the bucket in contact with the ground. In the case of the present embodiment, however, outside signals that are transmitted from the switch 38 when the switch 38 is on release the check valve 37 from the checking function so as to permit the boom cylinder 6 to easily extend or contract in response to an external force in the axial direction. Therefore, gravel or debris can be easily raked in by merely drawing the arm and opening the bucket in the state the boom-down lever is appropriately operated.

(5) When performing slope tamping while the switch 38 is on, the vehicle is free from the problem of rising when the bucket hits the ground. The embodiment thus facilitates continuous slope tamping.

FIG. 4 shows another embodiment of the invention. Whereas the embodiment shown in FIG. 1 refers to an example where each of the directional control valves 2, 19, 23, 24, 25 and the regeneration valve 13 is a solenoid-operated valve provided with solenoids (2*a*, 2*b*, etc.), the embodiment shown in FIG. 4 uses a plurality of electromagnetic proportional control valves 45, which correspond to the directional control valves 2, 19, 23, 24, 25 and the regeneration valve 13. Each electromagnetic proportional control valve 45 functions to convert a pilot source pressure, which is supplied from a pilot pressure source 46, to an external pilot pressure that is in proportion to an electric signal output from the controller 3, and, based on the external pilot pressure, pilot-operate the appropriate valve from among the pilot-operated directional control valves 2, 19, 23, 24, 25 and the regeneration valve. Numerals 2A, 2B denote pilot-pressure receiving portions that face the spool of the first boom directional control valve 2.

As described above, the embodiment shown in FIG. 4 is similar to the embodiment shown in FIG. 1 except for that the directional control valves 2, 19, 23, 24, 25 and the regeneration valve 13 are shifted by means of external pressures from the electromagnetic proportional control valves 45, whereas the embodiment shown in FIG. 1 calls for shifting the directional control valves 2, 19, 23, 24, 25 and the regeneration valve 13 directly by means of the solenoids. Therefore, a detailed explanation of the circuit is omitted herein.

In the embodiment shown in FIG. 4, an outside signal transmitted from the switch 38 to the check valve 37, which is of an outside-signal-operated type, may function as a hydraulic signal.

As described above, when lowering the boom by operating the boom cylinder 6, which serves as an hydraulic actuator, by means of an external load W while simultaneously operating another hydraulic actuator, e.g. the arm cylinder 26 or the bucket cylinder 27, in the state that the bucket is off the ground, controlling the first boom directional control valve 2, which is one of the two directional control valves, to the neutral position and the regeneration boom valve 13 to remain open enables the hydraulic oil to be regenerated from the line 9 located at the oil-returning side of the boom cylinder 6 through the regeneration boom valve 13 to the line 5 located at the oil-feeding side of the boom cylinder 6. Therefore, the hydraulic oil that can be supplied from the pressurized oil source 4 to the arm cylinder 26 or the bucket cylinder 27 via another directional control valve, i.e. the second arm directional control valve 24 or the bucket directional control valve 25, is increased by the amount equivalent to the amount of the oil that is not supplied from the pressurized oil source 4 to the boom cylinder 6. As a result, the arm cylinder 26 or the bucket cylinder 27 can work faster in comparison with conventional circuits. The circuit according to the invention thus increases the operating efficiency of simultaneous operation of hydraulic actuators of a hydraulic excavator.

In cases where the boom cylinder 6 can be actuated by opening the regeneration boom valve 13 even when the first boom directional control valve 2 is at the neutral position, the hydraulic oil fed from the pressurized oil source 4 to the first boom directional control valve 2 is discharged through the first boom directional control valve 2, which is at the neutral position, to the tank line 11. Therefore, the invention is effective in preventing energy loss that would otherwise occur as a result of unnecessary supply of the hydraulic oil from the pressurized oil source 4 to the boom cylinder 6.

By shifting to the boom-down position, the second boom directional control valve 19, which is yet another directional control valve, becomes capable of discharging the hydraulic oil into the tank line 11 without closing off the center by-pass line 34. By shifting to the boom-down position, the second boom directional control valve 19 becomes also capable of discharging into the tank line 11 the excess hydraulic oil delivered from the boom cylinder 6. Therefore, the energy loss can be reduced.

Furthermore, by shifting to the boom-up position, the second boom directional control valve 19 becomes capable of joining the flow of hydraulic oil supplied from the pressurized oil source 20 with the flow of the hydraulic oil supplied from the first boom directional control valve 2 to the boom cylinder 6, thereby increasing the working speed of the boom cylinder 6.

Should the flow rate of the regenerated oil become insufficient, the hydraulic oil that would be sufficient to make up for the shortage can be introduced from the tank line 11 through the makeup check valve 42 and supplied to the boom cylinder 6.

The check valve 37 normally prevents the reverse flow of the hydraulic oil and secures only the flow of the regenerated hydraulic oil discharged from the boom cylinder 6, which is operated by an external load W. When an outside signal is transmitted from the switch 38 to the check valve 37, the checking function of the check valve 37 to prevent the reverse flow is stopped. Another benefit of the invention lies in its ability to permit an external force to move the boom cylinder 6 through operation of the switch 38.

When raking in gravel or debris with the bottom of the bucket of a hydraulic excavator, a conventional circuit requires the operator of the excavator to perform triple combined operation, which calls for simultaneously performing boom-up, arm-drawing, and bucket-opening. According to the present invention, however, the boom cylinder 6 is capable of extending or contracting at will in the axial direction in response to an external force, provided that the regeneration boom valve 13 is open and that the switch 38 is on. Therefore, gravel or debris can be easily raked in by merely drawing the arm and opening the bucket while pushing the front attachment downward by maintaining the first boom directional control valve 2 in the boom-down mode.

In the course of slope tamping, which calls for hardening the ground by tamping it with the bottom of the bucket by lowering the boom, when the pressure of the hydraulic oil to the rod-side 7 of the boom cylinder 6 tends to increase with the bucket coming into contact with the ground, the pressure is released to the tank line 11 via the check valve 37 when the switch 38 is on, the regeneration boom valve 13 in the open state, and the return-oil control orifice 17 of the first boom directional control valve 2. Therefore, as an impact of the bucket with the ground will not produce a boom-down force that is great enough to raise the vehicle, continuous slope tamping can easily be performed.

When an outside signal is input from the switch 38 into the check valve 37 by turning on the switch 38 in the state where there is a high pressure at the rod-side 7, in other words in the state where the bucket is in contact with the ground with the vehicle body in the raised state as a result of boom-down operation by the boom cylinder 6, the checking function of the check valve 37 is stopped. Therefore, should the operator unintentionally performs boom-down operation, in other words unintentionally try to further raise the vehicle body, the regeneration boom valve 13 immediately shifts to the open state so that the hydraulic oil at the rod-side 7 of the boom cylinder 6 flows through the check valve 37 and the regeneration boom valve 13 to the head-side 8, thereby causing the rod of the boom cylinder 6 to extend, resulting in boom-up action and, consequently, causing the vehicle body to fall to the ground. However, the circuit of the invention described above is capable of preventing such unintentional falling of the vehicle body, because the circuit has a function as a switch-signal canceling means, which calls for controlling the switch signal control unit 43 by the controller 3 so as to interrupt signals from the switch 38 when P>Pd.

POSSIBLE INDUSTRIAL APPLICATION

The use of a hydraulic circuit according to the invention is not limited to a hydraulic excavator; it is also applicable to any other work machine that operates a plurality of hydraulic actuators simultaneously.

What is claimed is:

1. A hydraulic circuit including:

one directional control valve adapted to receive hydraulic fluid from a pressurized fluid source and control the direction of the flow of the hydraulic fluid by shifting the position of said directional control valve;

one hydraulic actuator adapted to be operated by an external load or hydraulic fluid, of which the direction of the flow is controlled by the said directional control valve;

a regeneration valve for opening or closing off a passage that connects the fluid-returning side and the fluid-feeding side of said hydraulic actuator operated by an external load;

a pressure detector for detecting load pressure applied to said hydraulic actuator;

at least one other directional control valve adapted to receive hydraulic fluid from the pressurized fluid source and control the direction of the flow of the hydraulic fluid by shifting the position of said other directional control valve(s);

at least one other hydraulic actuator adapted to be operated by hydraulic fluid, of which the direction of the flow is controlled by said other directional control valve(s); and a controller that is adapted to, upon detecting the load pressure to said one hydraulic actuator to be low by means of said pressure detector, shift said one directional control valve to the neutral position, thereby interrupting the flow of the hydraulic fluid to said one hydraulic actuator, and simultaneously control the regeneration valve to be open.

2. A hydraulic circuit as claimed in claim 1, wherein said one directional control valve is capable of discharging into the tank the hydraulic fluid that has been fed from the pressurized fluid source when said one directional control valve is at the neutral position.

3. A hydraulic circuit as claimed in claim 1, wherein the hydraulic circuit includes yet another directional control valve adapted to receive hydraulic fluid from a pressurized fluid source other than the one mentioned above and shift the position of said yet another directional control valve so that, by shifting to one position, said yet another directional control valve permits the hydraulic fluid fed from the other pressurized fluid source an the hydraulic fluid returned from said one hydraulic actuator to be discharged into the tank and that, by shifting to another position, said yet another directional control valve supplies the said on hydraulic actuator with the hydraulic fluid fed from the other pressurized fluid source.

4. A hydraulic circuit as claimed in claim 1, wherein:

the hydraulic circuit includes a check valve and a switch adapted to transmit an outside signal to the check valve; and the check valve is adapted to:

function with the direction in which the hydraulic fluid discharged from said one hydraulic actuator when said one hydraulic actuator is operated by an external load flows back through the regeneration valve to said one hydraulic actuator being regarded as the normal direction, and permit, when receiving an appropriate outside signal, the hydraulic fluid to flow in the reverse direction.

5. A hydraulic circuit as claimed in claim 4, wherein the hydraulic circuit includes a makeup check valve that is capable of feeding hydraulic fluid from the tank to a portion located downstream from the regeneration valve in the flow of regenerated fluid so as to make up deficiency of hydraulic fluid in that portion.

6. A hydraulic circuit as claimed in claim 4, wherein:

said hydraulic actuator is a boom cylinder for raising or lowering the boom of a front attachment of a hydraulic excavator;

a plurality of hydraulic actuators comprise said other hydraulic actuator, said plurality of hydraulic actuators including at least an arm cylinder for swinging the arm, which is supported at the end of the boom by means of a shaft, and a bucket cylinder for swinging the bucket, which is supported at time end of the arm by means of a shaft; and at least said one directional control valve has a return-oil control orifice adapted to reduce the return oil discharged from the head-side of the boom cylinder into the tank when said one directional control valve is at the boom-down position.

7. A hydraulic circuit as claimed in claim 6, wherein the controller has a function to control the circuit so that when pressure at the rod-side of the boom cylinder is greater than a given standard pressure, an outside signal for releasing the check valve from checking the reverse flow is prevented from being input from the switch to the check valve even if the switch is turned on.

8. A hydraulic circuit as claimed in claim 1, wherein:

said one hydraulic actuator is a boom cylinder for raising or lowering the boom of a front attachment of a hydraulic excavator, and said other hydraulic actuator is a hydraulic actuator or hydraulic actuators other than the boom cylinder of the hydraulic excavator.

* * * * *

UNITED STATES PATENT AND TRADEMARK OFFICE

CERTIFICATE OF CORRECTION

PATENT NO. : 6,877,417 B2
DATED : April 12, 2005
INVENTOR(S) : Yoshiyuki Shimada It is certified that error appears in the above-identified patent and that said Letters Patent is hereby corrected as shown below:

Title page,
Item [54], Title, please delete "FLUID PRESSURE CIRCUIT" and substitute -- HYDRAULIC CIRCUIT --.

Signed and Sealed this

Twenty-eighth Day of June, 2005

JON W. DUDAS
*Director of the United States Patent and Trademark Office*